US006430850B1

(12) United States Patent
VanDerZyl et al.

(10) Patent No.: US 6,430,850 B1
(45) Date of Patent: Aug. 13, 2002

(54) SEAT SWITCH ACTIVATED PUMP

(75) Inventors: Roger Dale VanDerZyl, East Dubuque, IL (US); Mark Arnold Litka, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/624,954

(22) Filed: Jul. 25, 2000

(51) Int. Cl.[7] ..... E02F 3/96

(52) U.S. Cl. ..... 37/410; 37/348; 60/486; 172/2; 414/699

(58) Field of Search ..... 37/403, 410, 348; 172/2, 3, 7, 8; 60/428, 486; 414/699, 694

(56) References Cited

U.S. PATENT DOCUMENTS

| | | | | |
|---|---|---|---|---|
| 3,975,909 A | | 8/1976 | McBurnett | 60/421 |
| 4,116,577 A | | 9/1978 | Lauck | 417/286 |
| 4,561,341 A | * | 12/1985 | Aikawa | 60/486 |
| 4,699,561 A | * | 10/1987 | Tee | 414/699 |
| 4,934,462 A | | 6/1990 | Tatara et al. | 172/2 |
| 5,052,512 A | * | 10/1991 | Pakosh et al. | 180/329 |
| 5,092,408 A | | 3/1992 | Tatara et al. | 172/2 |
| 5,136,846 A | * | 8/1992 | Arii et al. | 60/468 |
| 5,615,553 A | * | 4/1997 | Lourigan | 60/486 |
| 6,050,367 A | * | 4/2000 | Tvetene et al. | 187/234 |
| 6,129,158 A | | 10/2000 | Yamamoto | 172/812 |
| 6,170,412 B1 | * | 1/2001 | Memory et al. | 60/486 |
| 6,182,588 B1 | * | 2/2001 | Bodie et al. | 60/486 |
| 6,226,902 B1 | * | 5/2001 | Heyne | 37/348 |

FOREIGN PATENT DOCUMENTS

| | | | |
|---|---|---|---|
| GB | 2215700 | * | 9/1989 |
| WO | WO 01 29328 | | 4/2001 |
| WO | WO 01/29328 A1 | * | 4/2001 |

* cited by examiner

*Primary Examiner*—Robert E. Pezzuto
*Assistant Examiner*—Nathan Mammen

(57) ABSTRACT

A backhoe loader is provided with a reversible operator's seat having a first working position facing the loader and a second working position facing the backhoe. A first hydraulic pump directs pressurized hydraulic fluid through a first supply line to loader control valves, stabilizer control valves and backhoe control valves that are mounted in series. A second hydraulic pumps directs pressurized hydraulic fluid through a second supply line to the first supply line upstream from the loader control valves. The second supply line is provided with a two-position solenoid valve. In its first position, the valve directs pressurized hydraulic fluid from the second hydraulic pump to sump. In its second position, the valve directs pressurized hydraulic fluid from the second hydraulic pump to the first supply line. The solenoid of the two-position solenoid valve is in electrical communication with a seat switch signaling the working position of the operator's seat.

12 Claims, 2 Drawing Sheets

10
12
14
14
16
18
20
22
24
26
27
28
30
32
34
36
38
40
42
46
48
50
52

SEAT SWITCH ACTIVATED PUMP

BACKGROUND OF THE INVENTION

1. Field of the Invention

The present invention is directed to a work vehicle having an operator's seat with two working positions for controlling two work implements, wherein the position of the operator's seat controls the application of a hydraulic pump to the second work implement.

2. Description of the Prior Art

Backhoe loaders are a common type of work vehicle for performing two work operations. The backhoe loader is provided with a front mounted loader and a rear mounted backhoe. The operator's cab is provided with a reversible seat which faces forward for transport and loading operations and to the rear for backhoe operations.

The backhoe functions of the backhoe has a higher fluid demand than the loader functions of the loader. To provide sufficient fluid, a second fluid gear pump has been provided supplying additional pressurized hydraulic fluid to the backhoe control valves. In current production machines, a first hydraulic gear pump supplies pressurized hydraulic fluid to the loader control valves, the stabilizer control valves and the backhoe control valves in series through a first supply line. A second supply line directs pressurized hydraulic fluid from the second hydraulic gear pump to the first supply line upstream from the backhoe control valves and downstream from the stabilizer control valves.

Other backhoe loader manufacturers have used manually operated switches to decouple one of the pumps from the hydraulic circuit.

SUMMARY

It is an object of the present invention to provide a simple and automatic mechanism for coupling and decoupling a second hydraulic pump to the operation of a second work implement.

A backhoe loader is provided with a front mounted loader and a rear mounted backhoe. The operator's cab of the backhoe loader is provided with a reversible operator's seat having a first working position facing the loader and a second working position facing the backhoe. A first hydraulic pump directs pressurized hydraulic fluid through a first supply line to backhoe control valves, stabilizer control valves and loader control valves that are mounted in series. A second hydraulic pump directs pressurized hydraulic fluid through a second supply line to the first supply line upstream from the loader control valves. The second supply line is provided with a two-position solenoid valve. In its first position the valve directs the pressurized hydraulic fluid from the second hydraulic pump to sump. In its second position the valve directs pressurized hydraulic fluid from the second hydraulic pump to the first supply line. The solenoid of the two-position solenoid valve is in electrical communication with a detector. The detector sends a first signal if the operator's seat is in its first working position and a second signal if the operator's seat is in its second working position. The detector is a conventional seat switch currently used on production backhoe loaders for different applications.

DETAILED DESCRIPTION

Figure 1:
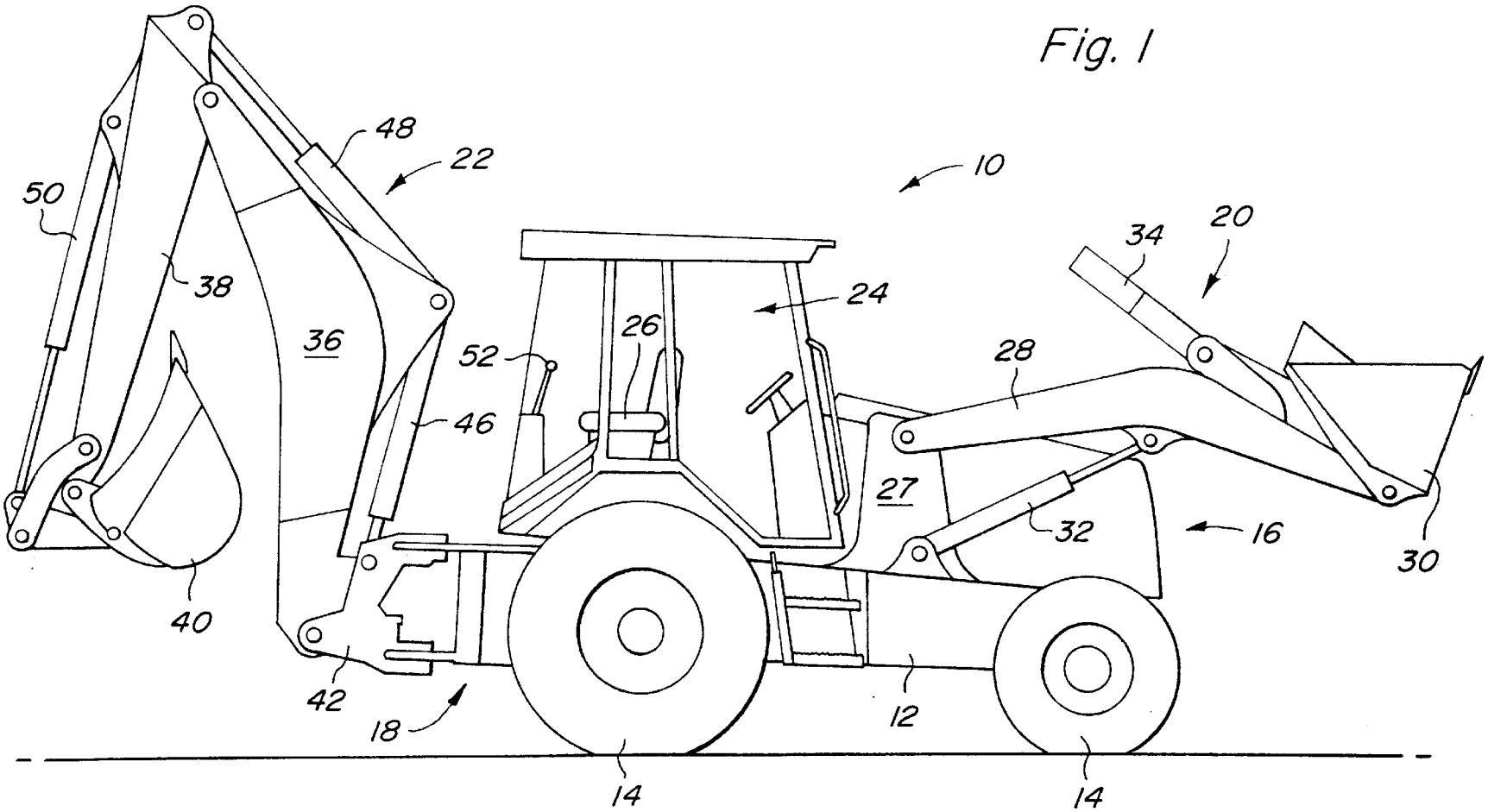
FIG. 1 is a side view of a backhoe loader work vehicle.

The work vehicle 10 illustrated in FIG. 1 is a backhoe loader. The work vehicle 10 is provided with a supporting structure 12 and ground engaging means 14 comprising wheels, which support and propel the supporting structure 12. Although the ground engaging means 14 of the illustrated embodiment are wheels, the present invention could also be used on tracked work vehicles having steel or rubber tracks. The supporting structure 12 has a front 16 and a back 18. A first work implement 20 comprising a loader is mounted to the front 16 of the supporting structure 12. A second work implement 22 comprising a backhoe is mounted to the back 18 of the supporting structure 12.

The operation of the work vehicle 10 and the operation of the first and second work implements 20 and 22 are controlled from operator's cab 24. The operator's cab 24 is provided with a two-position operator's seat 26. In its first position, the operator's seat 26 faces forwardly towards the front 16 of the work vehicle 10. In this first position, the operator can drive the vehicle and operate the loader 20. In its second position, illustrated in FIG. 1, the operator's seat 26 faces rearwardly towards the back 18 of the work vehicle 10. In this second position the operator controls the operation of the backhoe 22.

The loader 20 is mounted to the front 16 of the supporting structure 12 by a mast 27 and comprises lift arms 28 and a bucket 30. The lift arms 28 are provided with lift arm hydraulic cylinders 32 for lifting the arms 28 relative to the supporting structure 12. The bucket 30 is pivotally mounted to the end of the lift arms 28. Bucket 30 is provided with a bucket-tilt hydraulic cylinder 34 for tilting the bucket 30 relative to the lift arms 28.

The backhoe 22 is mounted to the back 18 of the supporting structure 12 and comprises a boom 36, a dipperstick 38 and a bucket 40. The boom 36 is pivotally coupled to a swing frame 42 about a vertical pivot and is raised and lowered relative to the swing frame 42 by a boom hydraulic cylinder 46. The dipperstick 38 is pivotally mounted to the boom about a horizontal axis and is pivoted relative to the boom 36 by dipperstick hydraulic cylinder 48. The bucket 40 is curled and uncurled relative to the dipperstick 38 by bucket hydraulic cylinder 50. The operation of the backhoe 22 is controlled by an operator manipulating control levers 52 located in the operator's cab 24.

In the illustrated embodiment the swing frame 42 is pivotally coupled to the support structure 12. The swing frame 42 is pivoted relative to the supporting structure by swing frame hydraulic cylinders, not shown. The swing frame 42 could also be mounted to a side shift structure located between the swing frame 42 and the supporting structure for laterally shifting the swing frame relative to the supporting structure 12. The backhoe would normally be provided with stabilizers, not shown.

Figure 2:
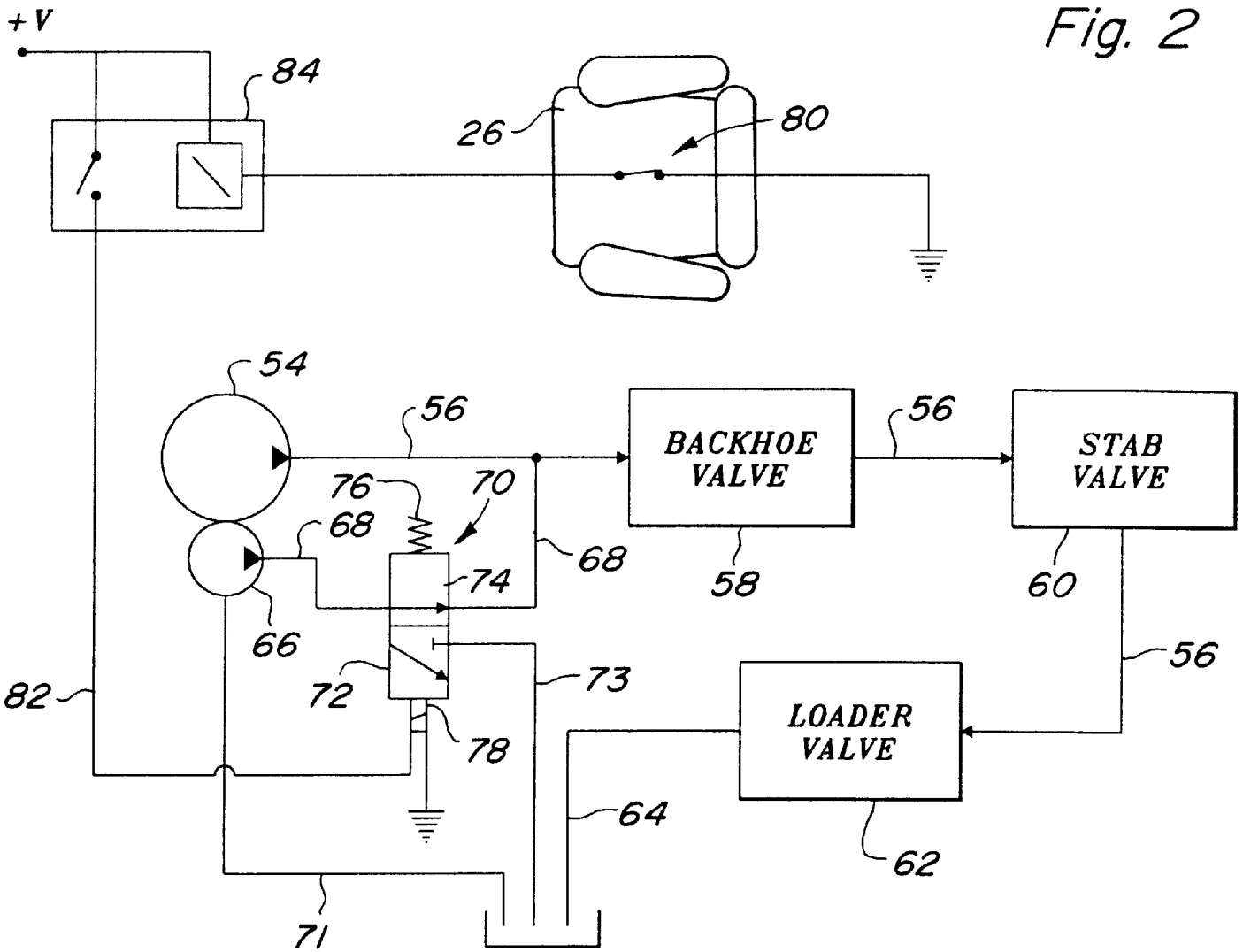
FIG. 2 is an electrical and hydraulic schematic of the present invention.

As illustrated in FIG. 2, a first hydraulic gear pump 54 directs pressurized hydraulic fluid through a first supply line 56 to the backhoe 22 through backhoe control valves 58, to the stabilizers through the stabilizer control valves 60 and to the loader 20 through loader control valves 62. These control valves 58, 60 and 62 are mounted in series along the first supply line 56 one after the other. The exhausted fluid is returned to sump through hydraulic return line 64. A second hydraulic gear pump 66 directs pressurized hydraulic fluid through a second supply line 68 to the first supply line 56 upstream from the backhoe control valves 58. The flow of pressurized hydraulic fluid through the second supply line 68 is controlled by a two-position solenoid valve 70. The first and second hydraulic pumps 54 and 66 receive hydraulic fluid from the sump through hydraulic line 71.

The two-position solenoid valve 70 has a first position 72 wherein pressurized hydraulic fluid from the second hydraulic pump 66 is directed to sump through return line 73. The two-position solenoid valve has a second position 74 wherein pressurized hydraulic fluid from the second hydraulic pump 66 is directed to the first supply line 56. The valve 70 is normally biased into its second position 74 by spring 76. The valve 70 is driven into its first position 72 by energizing solenoid 78.

The energization of the solenoid 78 is controlled by a detector 80 comprising a seat switch used to detect if the seat is in its first working position facing to the front towards the loader, or is in its second working position facing rearwardly towards the backhoe. When the operator's seat 26 is in its first working position facing the loader 20, the seat switch is opened closing relay 84 and providing a first signal to solenoid 78. When the seat switch is opened, the solenoid 78 is energized shifting the two-position valve 78 into its first position 72. In its first position 72, the valve 70 directs pressurized hydraulic fluid from the second hydraulic pump 66 directly to sump. When the operator's seat 26 is rotated approximately 15 degrees from its first working position towards its second working position, the seat switch is closed opening relay 84 and providing a second signal to solenoid 78. When the seat switch is closed the solenoid is deenergized and the spring 76 biases the valve 78 into its second position 74. In its second position 74, valve 70 directs pressurized hydraulic fluid from the second hydraulic pump 66 to the first supply line 56. The seat switch is in electrical communication with the relay 84 and the solenoid 78 by electrical line 82.

The invention should not be limited by the above described embodiments, but should be limited solely by the claims that follow.

We claim:

1. A work vehicle for performing a first work operation and a second work operation, the work vehicle comprising:

a supporting structure;

ground engaging means for propelling the supporting structure;

an operator's seat mounted to the supporting structure, the operator's seat having a first work position and a second work position;

a first work implement is mounted to the supporting structure and is operated when the operator's seat is in its first work position;

a second work implement is mounted to the supporting structure and is operated when the operator's seat is in its second work position;

a first hydraulic pump for directing pressurized hydraulic fluid to the first and second work implements;

a second hydraulic pump for directing pressurized hydraulic fluid to the second work implement;

whereby the second hydraulic pump is automatically coupled to the first and second work implements when the operator's seat is in its second work position and is automatically decoupled from the first and second work implements when the operator's seat is in its first work position.

2. A work vehicle as defined by claim 1 wherein the first hydraulic pump is coupled to the first and second work implements by a first supply line and the second hydraulic pump is coupled to the first supply line by a second supply line.

3. A work vehicle as defined by claim 2 further comprising a detector for sending a first signal if the operator's seat is in its first work position and a second signal if the operator's seat is in its second work position.

4. A work vehicle as defined by claim 3 wherein the second supply line is provided with a two-position valve, the two-position valve having a first position that directs pressurized hydraulic fluid from the second hydraulic pump to the first supply line and a second position that directs the pressurized hydraulic fluid from the second hydraulic pump to a hydraulic fluid sump.

5. A work vehicle as defined by claim 4 wherein when the operator's seat is in its first work position it faces the first work implement and when the operator's seat is in its second work position it faces the second work implement.

6. A work vehicle as defined by claim 5 wherein the frame has a front and a back, the first work implement is mounted on the front of the frame and the second work implement is mounted on the back of the frame.

7. A work vehicle as defined by claim 6 wherein the detector is an electrical switch and the two-position valve is a solenoid valve, the switch is in electrical communication with the solenoid valve.

8. A work vehicle as defined by claim 7 wherein the first work implement is a loader and the second work implement is a backhoe.

9. A backhoe loader, comprising:

a supporting structure, the supporting structure having a front and a back;

ground engaging means for propelling the supporting structure;

an operator's seat mounted to the supporting structure, the operator's seat having a first work position and a second work position;

a loader is mounted to the front of the supporting structure and is operated when the operator's seat is in its first work position, the loader being controlled by loader control valves;

a backhoe is mounted to the back of the supporting structure and is operated when the operator's seat is in its second work position, the backhoe being controlled by backhoe control valves;

a first hydraulic pump for directing pressurized hydraulic fluid to a first supply line with the loader control valves and the backhoe control valves arranged in series along the first supply line, with the backhoe control valves being upstream from the loader control valves;

a second hydraulic pump for directing pressurized hydraulic fluid to a second supply line, the second supply line extending between the second hydraulic pump and the first supply line upstream from the backhoe control valves;

a valve is located on the second supply line for controlling the flow of pressurized hydraulic fluid from the second hydraulic pump to the first supply line, whereby the valve directs pressurized hydraulic fluid from the second hydraulic pump to the first supply line when the operator's seat is in its second work position and the valve stops the flow of pressurized fluid from the second hydraulic pump to the first supply line when the operator's seat is in its first work position.

10. A backhoe loader as defined by claim 9 wherein the valve is a two-position solenoid valve having a first position for stopping the flow of pressurized hydraulic fluid from he second hydraulic pump to the first supply line and a second position for directing the flow of pressurized hydraulic fluid from the second hydraulic pump to the first supply line.

11. A backhoe loader as defined by claim 10 wherein the operator's seat is provided with a detector which is in electrical communication with the two-position solenoid control valve, the detector sending a first signal if the operator's seat is in its first work position and a second signal if the operator's seat is in its second work position.

12. A backhoe loader as defined by claim 11 wherein the detector comprises a seat switch.

* * * * *